US006079855A

United States Patent [19]

Azeredo et al.

[11] Patent Number: 6,079,855

[45] Date of Patent: Jun. 27, 2000

[54] DETACHABLE DECORATIVE SYSTEM FOR LAMP SHADES

[76] Inventors: Ruth Ann Azeredo, 2716 Keystone La., Bowie, Md. 20715; Rita Morgan, 6217 Homespun La., Falls Church, Va. 22044

[21] Appl. No.: 09/064,916

[22] Filed: Apr. 23, 1998

[51] Int. Cl.[7] ..... F21V 11/00

[52] U.S. Cl. ..... 362/356; 362/351; 362/357; 362/396; 362/433; 362/806

[58] Field of Search ..... 362/356, 357, 362/358, 351, 433, 396, 806

[56] References Cited

U.S. PATENT DOCUMENTS

| | | | |
|---|---|---|---|
| D. 65,374 | 8/1924 | Katz . | |
| D. 65,703 | 8/1924 | Ohm . | |
| 558,707 | 4/1896 | Aurand . | |
| 1,448,811 | 3/1923 | Morrison . | |
| 1,562,807 | 11/1925 | Thiel . | |
| 1,805,984 | 5/1931 | Hull . | |
| 2,007,580 | 7/1935 | Menge . | |
| 2,682,724 | 7/1954 | Pattillo . | |
| 2,786,345 | 3/1957 | Scherer . | |
| 2,812,442 | 11/1957 | Mun . | |
| 3,433,449 | 3/1969 | Musante . | |
| 4,221,118 | 9/1980 | Chicckine | 63/13 |
| 4,731,715 | 3/1988 | Anderson | 362/352 |
| 5,311,415 | 5/1994 | Hyland | 362/806 |
| 5,408,396 | 4/1995 | Stanely | 362/253 |
| 5,411,780 | 5/1995 | Kaefer | 428/38 |
| 5,611,618 | 3/1997 | Sawyer | 362/417 |
| 5,662,412 | 9/1997 | Glendmyer | 362/351 |

*Primary Examiner*—Sandra O'Shea
*Assistant Examiner*—John A. Ward
*Attorney, Agent, or Firm*—Robert G. Lev

[57] ABSTRACT

A decorative system for lamp shades and related articles relies upon a plurality of clips having spring tension between their parts. The clips are easily added or removed from a lamp shade or similar article without destroying or otherwise compromising the fabric of the lamp shade. Virtually every style, size and shape of lamp shade can be decorated by the present system.

17 Claims, 5 Drawing Sheets

DETACHABLE DECORATIVE SYSTEM FOR LAMP SHADES

TECHNICAL FIELD

The present invention generally relates to the decorative systems. In particular, the present invention is directed to a removable decorative system for lampshades.

BACKGROUND OF THE INVENTION

The construction of conventional lamp shades is well-known. Typically, replacement of lampshades is required long before the lamp itself is either worn out or must otherwise be replaced. Normally replacement of the lamp shade is due to decorative considerations. Unfortunately, conventional lamp shade design is severely constrained both in size and decorative considerations. Consequently, normal lamp shades are seldom appropriate means for decoration. Also, season or festive considerations may make it desirable to temporarily alter the appearance of lamp shades in order to reflect a desired atmosphere or specific decorative effect.

One arrangement for accomplishing such effects is disclosed in U.S. Pat. No. 4,731,715 to Anderson. The subject arrangement is directed to a conformable covering fabricated from a rectangular cloth which may be fitted over a conventional lamp shade.

Likewise, U.S. Pat. No. 5,311,415 to Hyland discloses a universal foldable lamp shade cover that is constructed by a uniformly pleated rectangular sheet of thin, rigid, yet bendable material having a plurality of side-by-side slender elongated panels integrally connected to one another in accordion fashion with a fold line between each panel. The cover is connected to the upper framework and spokes of the lamp shade frame. One version of the clip used to hold the lamp shade cover to the lamp shade has a roughly S-shaped configuration and at least one outer arm of the clip holds material to the middle portion under tension created by the spring-like qualities of the clip itself.

U.S. Pat. No. 1,562,807 to Thiel discloses a lamp shade decoration system in which decorative devices are held to a lamp shade by use of pins extending throughout the lamp shade materials. Only the design is discussed.

U.S. Pat. No. 4,221,118 to Chicckine discloses an earring holder configured as a serpentine rod. Spring action due to holder configuration helps to hold the earring to the ear.

U.S. Pat. No. 5,611,618 to Sawyer discloses a final for a lamp shade, which is screwed onto the stud of a lamp harp. A bail extends upwardly from the base and supports a hook from which an ornament can be suspended.

U.S. Pat. No. 4,433,449 to Musante discloses a decorative supporting hook assembly. The hook member is made of a strip of material having a hook on one end, and a fold near the opposite end. A decorative cover piece overlies the hook member while exposing the hook. The cover piece has a tapered cavity for frictionally receiving the fold.

U.S. Pat. No. 1,448,811 to Morrison discloses a weighted pendant used for holding down the edges of tablecloths. The pendant clips on the fabric of the tablecloth without damaging it.

U.S. Pat. No. 558,707 to Aurant discloses a carriage curtain fastener in the form of a hook which is adapted to be secured to the backstay of a carriage-top. The device includes means contained within the curtain for engaging the hook.

U.S. Pat. No. 2,682,724 to Pattillo discloses a replaceable ornament with an attaching plate for spectacle frames. The hook-shaped device is maintained under tension inherent to the material of the hook in order to hold decorative materials to the spectacle frame.

U.S. Design Pat. No. 65,703 to Ohm discloses a lamp shade having a decorative frame formed integrally as part of the lamp shade.

U.S. Design Pat. No. 65,374 to Katz discloses a decorative lamp shade having a decorative frame formed integrally as part of the lamp shade.

U.S. Pat. No. 2,812,442 to Mun discloses an electric light socket chain pull device. Ornamental device is held to the pullchain by means of a flexible metallic hook.

U.S. Pat. No. 1,805,984 to Hull discloses a combined door bumper and coat hanger having a multiple hook configuration.

U.S. Pat. No. 2,786,345 to Scherer discloses a candle holder for cakes. One version of the candle holder has a multiple hook configuration used to support candles by virtue of spring tension inherent to the curvature of the material used.

U.S. Pat. No. 2,007,580 to Menge discloses artistic hooks for supporting curtains on a rod.

As indicated by the aforementioned conventional art, a wide variety of sizes shapes and types of lamp shades exist. Consequently, standard fittings and decorations for lamps are impractical. Rather, only a highly flexible system of lamp decoration would be practical in order to adapt various decorating techniques to a wide variety of different lamp shade, sizes, shapes and fabrics.

None of the aforementioned examples of conventional art provides a flexible, system in which lamp shades can be easily and temporarily decorated in a variety of fashions while avoiding damage to the lamp shade itself while still maintaining the appearance of a permanent lamp shade design.

SUMMARY OF THE INVENTION

Accordingly it is a first object of the present invention to provide a lamp shade decorating system that can accommodate a wide variety of lamp shade sizes, shapes and fabric types.

It is another object of the present invention to provide a lamp shade decorating system that is easily installed and easily removed.

It is yet another object of the present invention to provide a lamp shade decorating system that avoids destruction or deterioration of the lamp shade fabric.

These and other goals and objects of the present invention are achieved by a decorating system which includes a lamp shade having stiffened members to provide support for the lamp shade fabric. Also included is at least one non utilitarian decorative device to be placed on the lamp shade and an attachable connecting device for removably attaching at least one of the decorative devices to the lamp shade.

BRIEF DESCRIPTION OF THE DRAWINGS

FIG. 4(*b*) is a front view diagram of the clip of FIG. 4(*a*).

FIG. 5(*b*) is a side view diagram of the clip used in the decorative system of the present invention.

FIGS. 10(*b*) and 10(*c*) are perspective view diagram depicting lamp shades decorated in accordance with the embodiment of FIG. 10(*a*).

FIG. 11(*b*) depicts the additional embodiments of the present invention used to decorate a lamp shade.

DETAILED DESCRIPTION OF THE PREFERRED EMBODIMENTS

Figure 6:
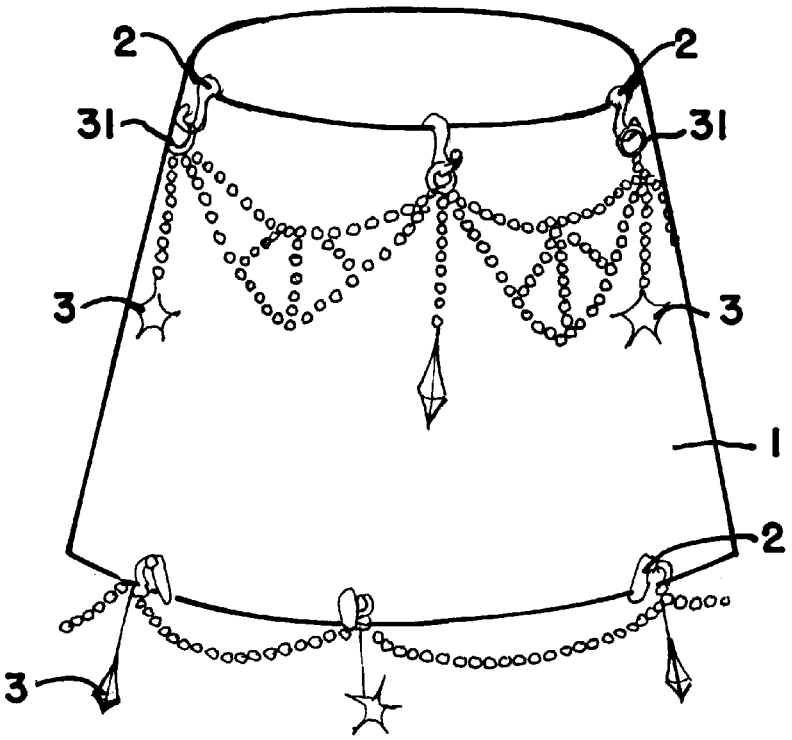
FIG. 6 is a perspective view diagram depicting a lamp shade decorated in accordance with the present invention.

FIG. 6 depicts a lamp shade 1 decorated in accordance with the system of the present invention. The lamp shade depicted is the standard truncated cone shape. Normally such lamp shades have upper and lower supporting frames constituted by flexible members (5,6 in FIG. 9), and the body of the lamp shade is constituted by some type of fabric. This fabric can be cloth, plastic, leather, paper products, or any combination thereof. The decorating system of the present invention works equally well with any type of fabric or framework constituting the lamp shade. While the shape of the lamp shade is the standard truncated cone version, the present invention can accommodate virtually any shape or size of a lamp shade that can be devised.

Figure 7:
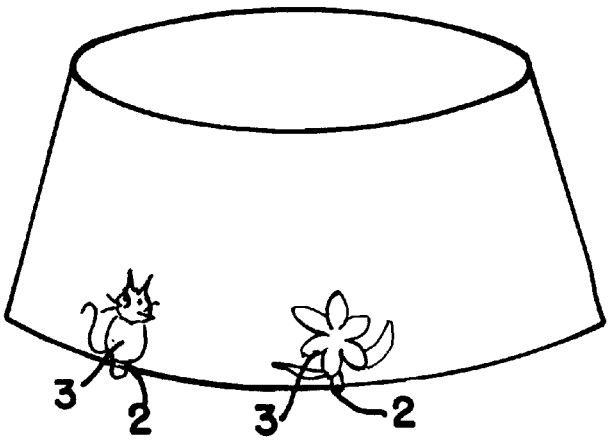
FIG. 7 is a perspective view diagram of lamp shade decorated using another embodiment of the clips that are used to hold the decorative device to the lamp shade.

The lamp shade 1 is decorated using non utilitarian artwork or other decorative devices 3. These decorative devices are held to the lamp shade by means of connecting devices 2. Preferably the connecting devices are in the form of clips that can hold onto the fabric of the lamp or the framework of the lamp while maintaining provision for attaching the decorative devices. Normally the decorative devices are connected to the connecting devices or clips by way of rings or hooks, provided either by the connecting devices or by the decorative devices. In another variation, as depicted in FIG. 7, the decorative devices are permanently fixed to the connecting devices.

Figure 1:
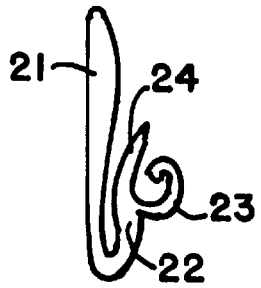
FIG. 1 is a side view diagram of one of the clips used in the decorative system of the present invention.

A key provision of the present invention is constituted by the clips 2 which are used as connecting devices, and are depicted in FIGS. 1–5. As indicated in FIG. 1, each clip has a first part 21 which preferably is arranged on the inside of the lamp shade. A median portion 22 is arranged to be in a "spring" relationship with the first part. The second part of the clip extends outward from the clip (and from the lamp shade) and constitutes the structure to which the decorative device is connected.

In FIG. 1 the structure for holding the decorative device 3 is a hook 23. A prong 24 is used to help keep the decorative device from falling off of the hook. The overall clip is formed so that spring tension exists between first part 21 and median part 22. These two parts may be in contact with each other or may be separated by an appropriate distance. However, there is a tendency for the two parts to squeeze any material placed between them if the thickness of the material exceeds the distance between the two parts. The spring tension created between the two parts is a function of the shape and material of the clip, and can be achieved by anyone having skill in the material art. The material constituting the clip can be a variety of metals, including but not limited to, spring steel, iron, brass, aluminum, silver, gold, etc. However, the clip does not have to be made out of metal since the same type of spring tension between the parts can be achieved with plastic or even rubber. It is also possible that ceramic materials can be used to constitute the clips.

Figure 2:
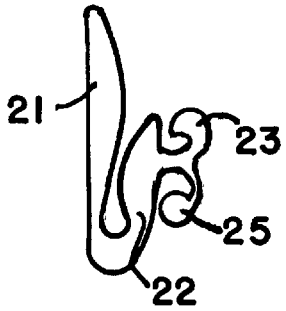
FIG. 2 is a side view of a diagram of another variation of the clip used in the decorative system of the present invention.

Another variation of clip 2 is depicted in FIG. 2. Here an additional hook 25 is provided so that the decorative device holding structure can have additional capacity. It should be noted that the clips of both FIGS. 1 and 2 are designed to fit at the top or the bottom of the lamp shade. In either variation, the frame of the lamp shade, including the flexible members (5 and 6 in FIG. 9) can be arranged within the curvature of the clip where the first part 21 and the median part 22 intersect. Preferably, the cavity at this point would be enlarged to accommodate the thickness of any frame member used to support the lamp shade.

Figure 3:
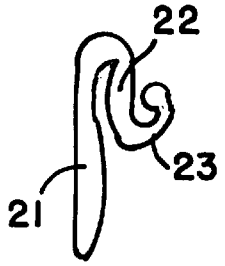
FIG. 3 is side view diagram of still another variation of the clip used in the decorative system of the present invention.
Figure 4A:
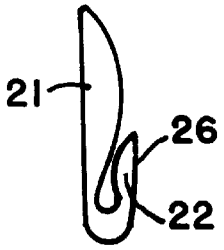
FIG. 4(*a*) is a side view diagram of a clip according to another embodiment of the present invention.
Figure 4B:
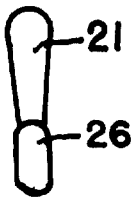

In contrast to FIGS. 1 and 2 which can be used at either the top or bottom of the lamp shade, the embodiment of FIG. 3 is designed to be used only at the top of the lamp shade. The embodiment of FIGS. 4(*a*) and 4(*b*) does not have a connecting structure 23 as is used in the embodiment of FIGS. 1–3. Rather, median portion 22 has a flat surface 26 to which a decorative device can be permanently bonded. Once this is done, the clip can be used at either the top or bottom of the lamp shade.

Figure 5A:
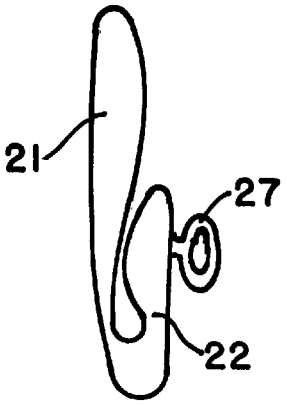
FIG. 5(*a*) is a side view diagram of another clip used in the decorative system of the present invention.
Figure 5B:
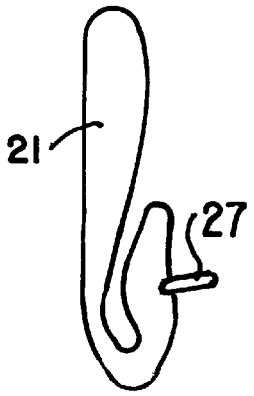

FIGS. 5(*a*) and 5(*b*) depict yet another variation of the clip 2. Instead of the hook structures, such as 23 depicted in FIGS. 1–3, a closed ring 27 is used as the structure for holding the decorative device. The closed ring 27 can be oriented as shown in FIG. 5(*a*) or as shown in FIG. 5(*b*). Also, the orientation may be arranged at some angle between those depicted in FIGS. 5(*a*) and 5(*b*). Also, additional closed rings can be provided to give the clip additional holding capacity.

Figure 8:
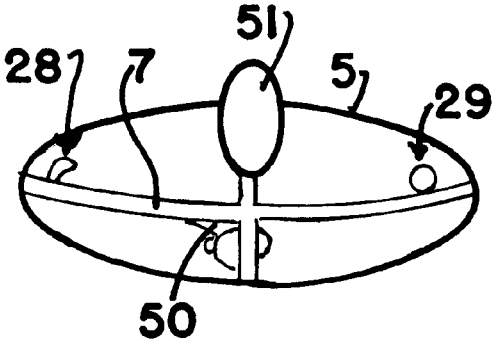
FIG. 8 is perspective view diagram of another embodiment of the decorative system of the present invention.
Figure 9:
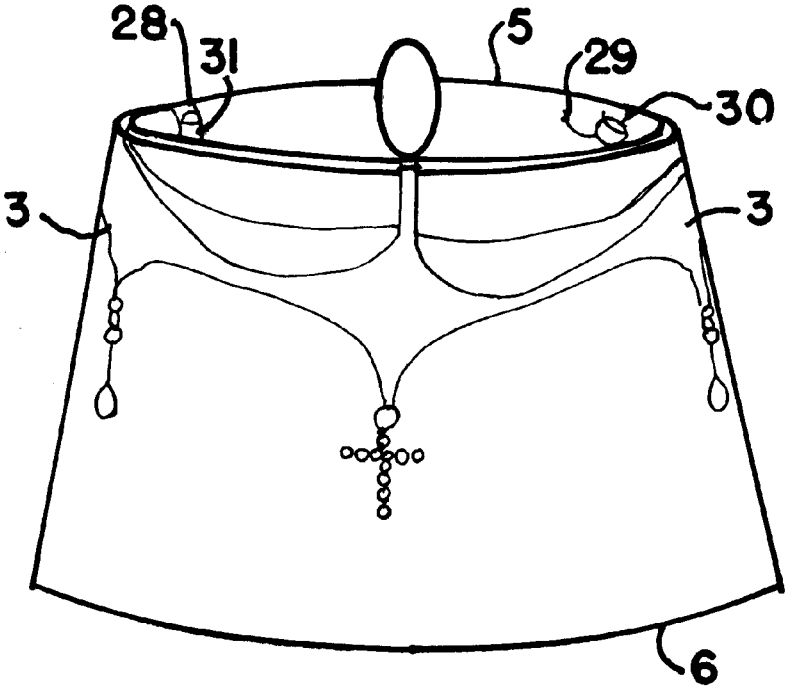
FIG. 9 is a perspective view diagram of a lamp shade decorated using the embodiment of FIG. 8.

Many lamp styles include the use of a final (mounted on top of the lamp harp), as well as spokes connecting the upper framework of the lampshade to the lamp harp. FIG. 8 depicts such an arrangement where the flexible member of the upper lamp frame 5 is connected to the lamp harp 50 by spokes 7. These spokes provide additional structure upon which connecting devices can be arranged. In this embodiment of the present invention a hook 28 and a closed ring 29 are arranged on spoke 7 near the framework 5 of the lamp shade. The decorative devices 3 will have either hooks 30 or rings 31 of its own to facilitate connection between the connecting devices permanently fixed to spoke 7. Such an arrangement is depicted in FIG. 9. Connecting devices such as 28 or 29 can be arranged on a single spoke or on all the spokes. Further, a final such as 51 can be used to connect the decorative devices as well.

Figure 10A:
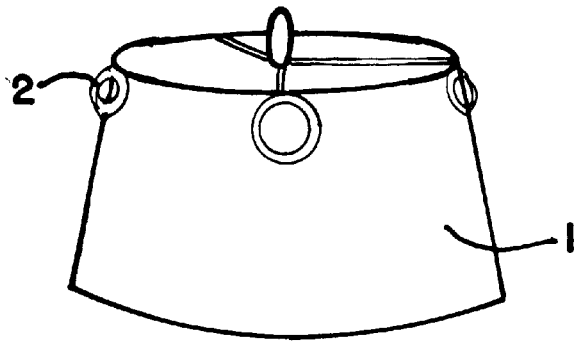
FIG. 10(*a*) is a perspective view diagram of an additional embodiment of the present invention.
Figure 10B:
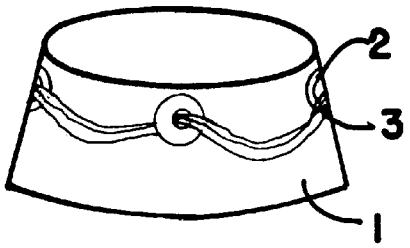
Figure 10C:
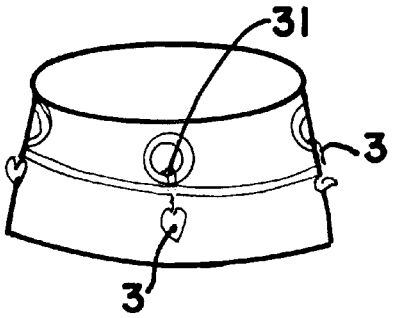

Another variation of the present invention is depicted in FIGS. 10(*a*)–10(*c*). As depicted in FIG. 10(*a*), the connecting devices 2 are permanently formed to either the lamp shade fabric or preferably the frame of the lamp shade 1. The connecting devices can be made out of fabric, wood, metal, plastic, or any appropriate material. The use of these permanent rings necessitates the use of corresponding hooks 31 to hold the decorative devices 3 to the connecting rings 2, as depicted in FIG. 10(*c*). In the alternative, decorative fabric 3 can be run through rings 2, thereby eliminating the need for hooks 31.

Figure 11A:
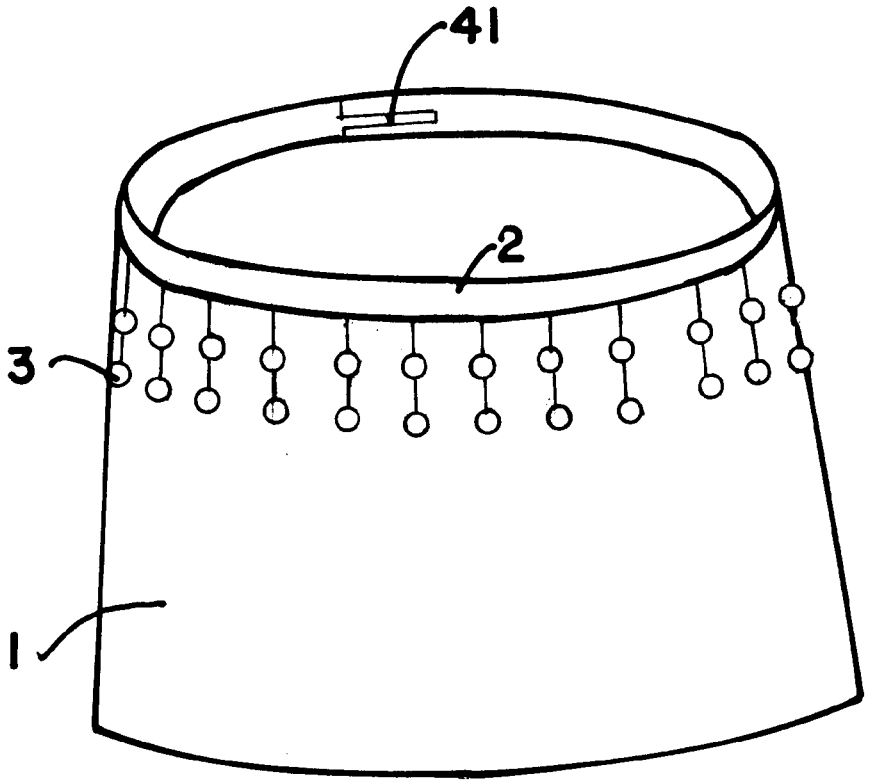
FIG. 11(*a*) is a front view diagram depicting a lamp shade decorated in accordance with an additional embodiment of the present invention.
Figure 11B:
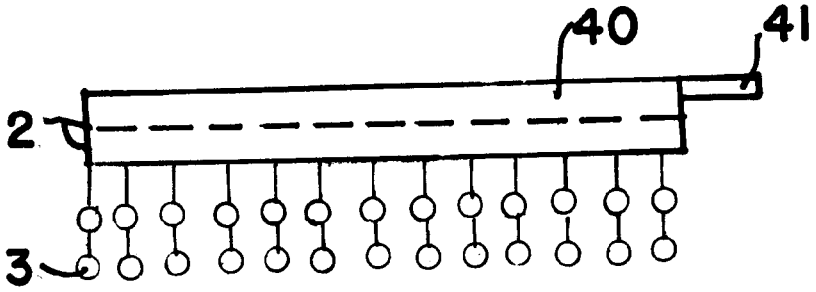

Another variation of the present invention is constituted by a connector device which folds over the top edge of the lamp shade 1. Such a connecting device 2 is depicted in FIG. 11(*b*). When this device is used the decorative items or devices 3 are preferably permanently connected thereto. The connecting device 2 uses a fold over section 40 which is bent over the top of the lamp shade and pressed against the interior side of the lamp shade. Also included in fold-over section 40 is a connector 41, which allows the two ends of the connecting device 2 to be held together as depicted in FIG. 11(*a*). The connector 41 is preferably made out of Velcro® but can be made out of any other appropriate material.

It should be noted that the portion 40 that folds over the top of the lamp shade need not cover the entire upper edge of the lamp shade. Rather, a fold over structure can be used to hold a decorative device 3 to the exterior of the lamp shade by folding over only a small portion of the upper edge of the lamp shade. Preferably the material that would be used to fold over the upper edge of the lamp shade (and along the inner surface of the lamp shade) would be non-flammable, as well as flexible. Aluminum is an ideal material for this structure especially if the fold-over portion is required to extend a substantial distance along the interior surface of the lamp shade.

In some cases it would not be necessary to have a fold over portion to connect the decorative devices to the lamp shade. If the lamp shade angles sharply outward immediately below the upper edge, a connecting device can be used to encircle the lamp shade just below the upper edge, with the ends of the connecting device being held together with some sort of connectors such as Velcro®. Such a structure would easily be able to support a substantial number of decorative devices.

It should be noted that the present invention is not necessarily limited to lamp shades. Rather, other devices such as vases, pots, draperies, etc. admit to easy use with the present invention. Additional decorative devices can be placed on the lamp shade or other fabric or surface to be decorated by use of magnets on the underside of the fabric which hold the metal piece attached to a decorative device firmly to the fabric where ever desired. This is especially important since the key aspects of the present invention are non-invasive and non-destructive characteristics.

While a number of other embodiments have been described by way of example, the present invention should not be interpreted to be limited thereby. Rather, the present invention should be construed to encompass all variations, modifications, permutations, adaptations or additions that would occur to one skilled in this art who has been taught the present invention by the instant patent application. Accordingly, the present invention should be construed to be limited only by the following claims.

We claim:

1. A decorating system for a lamp shade, said system comprising:

(a) a lamp shade fabric having stiffened members to provide support for said fabric;

(b) at least one non-utilitarian decorative device; and, (c) detachable connecting means for removably attaching said at least one decorative device, wherein said detachable connecting means comprise at least one clip having a first part and a second part and a median part, said first part arranged to provide spring tension against said median part thereby holding said fabric of said lamp shade, and said second part extending from said lamp shade and comprising holding means for holding said at least one decorative device.

2. The system of claim 1, wherein said holding means comprise a permanent bond between said second part and said at least one decorative device.

3. The system of claim 1, wherein said holding means comprise a single hook.

4. The system of claim 3, wherein said second part further comprises a prong aligned with said single hook.

5. The system of claim 1, wherein said holding means comprise a double hook.

6. The system of claim 1, wherein means for holding comprise a closed ring extending from said second part.

7. The system of claim 1, wherein a plurality of said clips hold a plurality of decorative devices, said decorative devices being connected to each other.

8. A decorating system for a lamp shade on a lamp having a central final, said system comprising:

(a) said lamp shade having fabric and stiffened members to provide support for said fabric, said stiffened members comprising a closed upper support connected to said final by a plurality of radial spokes;

(b) at least one non-utilitarian decorative device; and, (c) detachable connecting means for removably attaching said at least one decorative device.

said detachable connecting means comprising at least one hook arranged on at least one of said radial spokes.

9. The system of claim 8, wherein said detachable connecting means further comprise at least one closed ring arranged on at least one of said radial spokes.

10. The system of claim 9, further comprising upper and lower flexible members constituting a lamp shade frame, wherein at least one of said upper and lower flexible members has at least one permanent connecting means for holding said detachable connecting means.

11. The system of claim 10, wherein said permanent connecting means comprise at least one closed ring.

12. The system of claim 10, wherein said permanent connecting means comprise at least one hook.

13. A decorating system for a lamp shade, said system comprising:

(a) a lamp shade fabric having stiffened members to provide support for said fabric;

(b) at least one non-utilitarian decorative device; and, (c) detachable connecting means for removably attaching said at least one decorative device wherein said lamp shade has an upper edge, and said connecting means comprise folding means for bending and extending over said upper edge of said lamp shade to secure said at least one decorative device to said lamp shade; and, said detachable connecting means comprise a band having two ends and a connector arranged to connect said two ends together on an interior surface of said lampshade.

14. The system of claim 13, wherein said at least one decorative device is permanently attached to said folding means.

15. The system of claim 13, wherein said folding means cover said entire upper edge of said lamp shade.

16. The system of claim 15, wherein a portion of said folding means extends to an interior surface of said lamp shade, and includes two ends with a connector to connect said two ends together.

17. The system of claim 15, wherein said folding means are permanently connected to said at least one decorative device.

* * * * *